United States Patent [19]

Duwe et al.

[11] 4,102,098

[45] Jul. 25, 1978

[54] CRYPT CLOSURE PANEL AND METHOD FOR SEALING A CRYPT OPENING

[76] Inventors: Edward C. Duwe, 3840 Highland Shores; William E. Duwe, 1203 Washington Ave., both of Oshkosh, Wis. 54901

[21] Appl. No.: 796,736

[22] Filed: May 13, 1977

[51] Int. Cl.[2] ..... E04H 13/00; A61G 17/08

[52] U.S. Cl. ..... 52/140; 27/1; 220/357

[58] Field of Search ..... 52/128–142, 52/202; 220/352, 354, 356, 60; 229/5.5; 49/61; 160/368 R, 369; 27/1

[56] References Cited

U.S. PATENT DOCUMENTS

| | | | |
|---|---|---|---|
| 1,300,173 | 4/1919 | Kennedy | 52/136 |
| 1,454,958 | 5/1923 | Davies | 220/354 |
| 1,617,144 | 2/1927 | Berger | 52/131 |
| 2,247,617 | 7/1941 | Metz | 52/129 |
| 2,619,168 | 11/1952 | Leverence | 160/369 |
| 3,019,956 | 2/1962 | Muhlhoff | 220/356 |
| 3,581,452 | 6/1971 | Jalbert | 52/133 |
| 3,654,675 | 4/1972 | Peterson | 229/5.5 |
| 3,878,656 | 5/1975 | Duwe et al. | 52/79.14 |

*Primary Examiner*—James L. Ridgill, Jr.
*Attorney, Agent, or Firm*—Wigman & Cohen

[57] ABSTRACT

A lightweight closure panel for a crypt opening and a method of closing and sealing a crypt opening are disclosed. The closure panel is fabricated of synthetic plastic of substantially uniform thickness and comprises a central panel bounded about the perimeter thereof by a relatively resilient edge preferably in the form of a substantially U-shaped groove. The resilient edge of the closure panel is sufficiently flexible to form an interference fit between the closure panel and crypt opening when inserted therein so that a fluid-tight seal can be obtained.

9 Claims, 4 Drawing Figures

CRYPT CLOSURE PANEL AND METHOD FOR SEALING A CRYPT OPENING

BACKGROUND OF THE INVENTION

The present invention relates to a mausoleum crypt closure panel and to a method of sealing a crypt module opening. More particularly the present invention relates to a one-piece lightweight closure panel of synthetic plastic construction with edge sealing means provided.

In known above-ground mausoleum crypt systems of the type, for example, disclosed in our U.S. Pat. No. 3,878,656, after placement of a casket within a crypt, the crypt opening must be closed and sealed in a substantially air-tight manner to prevent outgassing or leakage of liquids which may develop within the crypt after interment. Heretofore, closing and sealing of the crypt opening has been accomplished by the use of conventional heavy, rigid closure panels made of asbestos-cement which are cut or cast to conform roughly to the size and shape of the crypt opening. The closure panel is then sealed over the crypt opening by means of a suitable sealant. To assure a reasonably proper fit for each opening of the several cast concrete crypts of the entire mausoleum system, the conventional closure panels must be dimensioned in such a way to fit the smallest possible size of crypt opening resulting from dimensional casting tolerances. In like manner, the closure panel must also be dimensioned to fit the largest possible size of crypt opening without excessive clearances.

Although conventional closure panels have been used extensively, they suffer from a number of disadvantages. For example, due to casting tolerances, the spacing between the edge of the closure panel confronting the crypt opening tends to be non-uniformly distributed about the perimeter of the closure panel. In particular, the spacing between the crypt opening and the lowermost edge of the closure panel, i.e., the edge which bears the weight of the closure panel, tends to be less than the spacing at other portions of the closure panel edge. Such non-uniform spacing can result in a poor seal between the closure panel and the opening which can result in undesirable leakage of gasses or liquids from the crypt. Although a closure panel could be individually sized or tailored to a particular crypt opening to minimize the leakage problem, the additional costs of such a procedure renders it economically prohibitive.

A further drawback of conventional closure panels of the aforementioned type is that they are heavy and frangible requiring special care and equipment in handling and in transportation. In particular, asbestos-cement closure panels when subjected to truck transportation or on-site use can be readily damaged at the critical edge portions of the closure panel where sealing in the crypt opening is effected. Additional cost in making, transporting and using the conventional closure panel has also been experienced when compared against the closure panel of the present invention.

It has been recently recognized that airborne asbestos particles are a potential health hazard to the human respiratory system, so that mechanical operations on asbestos cement board, such as cutting, grinding or milling, may pose a hazard to individuals performing such operations. Moreover, the possibility exists that the production of asbestos fiber for the manufacture of asbestos cement products may be severely limited by health authorities. The closure panel of the present invention eliminates the problems associated with asbestos.

A search of the prior art has uncovered U.S. Pat. Nos. 2,247,617 and 3,654,675, neither of which discloses or suggests the present invention. Nor are these prior art patents suitable for use with mausoleum crypts of the type contemplated by the present invention. Thus, U.S. Pat. No. 3,654,675 discloses a portable burial urn for retaining the cremated remains of humans which includes a thermoplastic tubular container of about six inches in diameter. The container is closed by a resilient cover adapted to permit fluid pressure equalization between the exterior and interior of the burial urn. The cover is molded of a thermoplastic material in the shape of a dished circular portion with a peripheral frusto-conical skirt about one-fourth the thickness of the circular portion.

U.S. Pat. No. 2,247,617 discloses a burial vault which includes a metal bottom section having a trough disposed about the perimeter thereof and a box-like metal top shell, the lower edge of which is curved upwardly and outwardly flared. The curved lower edge of the top shell is inserted into the trough in which there is disposed a seal material for sealing the trough and lower edge. The trough and lower edge of the shell are then secured together by means of bolts.

SUMMARY OF THE INVENTION

In view of the foregoing, it should be apparent that there still exists a need in the art for a crypt closure panel which overcomes the aforementioned disadvantages of the prior art devices. It is, therefore, a primary object of this invention to provide a crypt closure panel of lightweight, one-piece construction having a relatively resilient edge for forming an interference fit between the closure panel and a crypt opening and to provide an improved method for closing and sealing a crypt opening.

More particularly, it is an object of this invention to provide a crypt closure panel fabricated of a material of substantially uniform thickness and having a resilient edge of generally U-shaped configuration which forms an interference fit between the closure panel and crypt opening.

Another object of this invention is to provide a closure panel for a crypt opening which is self-centering and self-supporting within the crypt opening.

A further object of this invention is to provide an improved method of closing and sealing a crypt opening in a fluid-tight manner.

Yet another object of this invention is to provide a crypt closure panel made of a material which poses no recognized threat to the health of persons involved in the manufacture thereof.

Another object of this invention is to provide a crypt closure panel which can be economically manufactured, which is easy to transport because of the nesting design and nonfrangible characteristics of the panel, and which is easily handled and installed without special equipment.

Briefly described, these and other objects of the invention are accomplished in accordance with its apparatus aspects by a crypt closure panel bounded about the perimeter thereof by a resilient edge configured as a substantially U-shaped groove. The panel is shaped to conform to the shape of the crypt opening and the resilient edge is sufficiently flexible to form an interference fit with the confronting surfaces of the crypt opening in such a way that the closure panel is substantially centered in the opening and supportable therein solely by means of the forces exerted between the resilient edge and the crypt opening.

As used in the specification and claims herein, the term "interference fit" describes the dimensional relationship between the outermost perimeter of the closure panel and the innermost perimeter of the crypt opening and is intended to include closure panel perimeters equal to and greater than the perimeter of the crypt opening. Thus, consistent with the intended meaning of the term "interference fit", the force exerted between the resilient edge of the closure panel and the crypt opening surfaces could be of minimal magnitude so long as the force is sufficient to substantially centralize the closure panel in the crypt opening.

The method aspects of the invention are accomplished by providing a crypt closure panel having a resilient edge which conforms generally to the shape of a crypt opening to be closed and sealed. Prior to insertion of the closure panel into the crypt opening, a suitable sealant is applied to either the closure panel or crypt opening perimeters or both. The closure panel is then aligned with the crypt opening and urged into the opening against the force exerted between the closure panel and the surfaces of the crypt opening. Thereafter, a flexible adhesive tape is applied across the adjacent surfaces of the closure panel and front wall of the crypt surrounding the opening.

With these and other objects, advantages and features of the invention that may become hereinafter apparent, the nature of the invention may be more clearly understood by reference to the following description of a preferred embodiment of the invention, the appended claims and to the several views illustrated in the attached drawings.

DETAILED DESCRIPTION OF A PREFERRED EMBODIMENT

Figure 1:
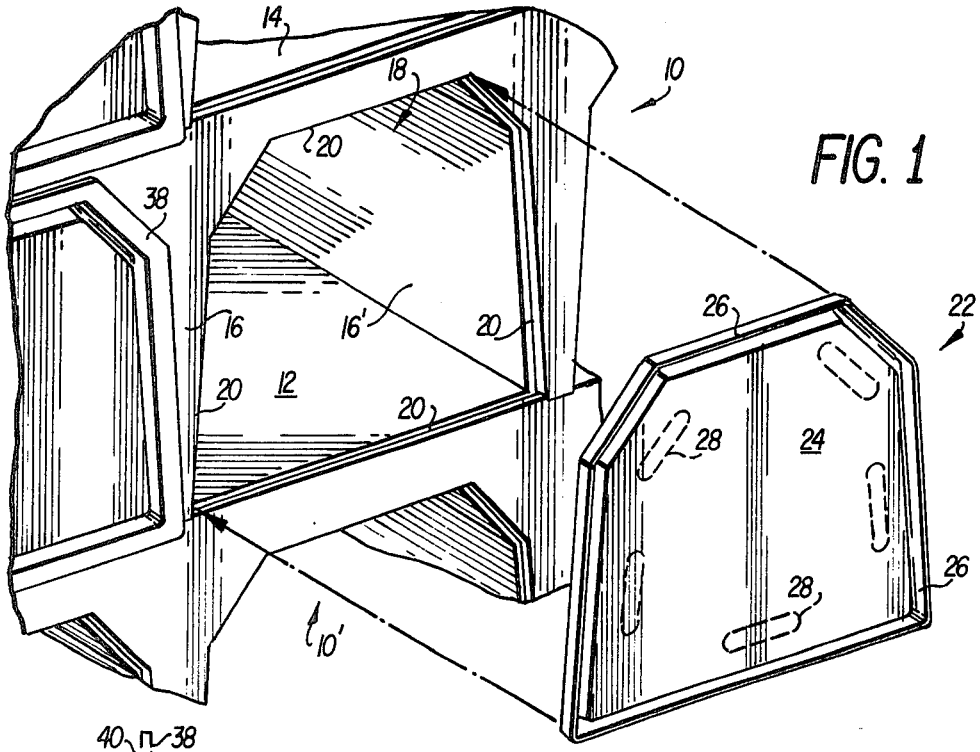
FIG. 1 is an exploded perspective view, partly broken, of a crypt module opening and closure panel of the present invention showing alternate embodiments of the closure panel.

Referring now to the drawings, and in particular to FIG. 1 thereof, there is illustrated a front wall of a a crypt module 10. The crypt module 10 is preferably cast of reinforced concrete and is adapted to be situated in a tier of a plurality of modules forming a complete mausoleum system of the type disclosed in our aforementioned U.S. Pat. No. 3,878,658. In the arrangement illustrated in FIG. 1, the module 10 is superposed on a top slab 12 of another module 10' situated beneath module 10. The module 10 includes a top slab 14 and side walls 16, 16' which, together with the top slab 12 of module 10', define a polygonal opening 18 of a crypt, the size of the opening 18 being sufficient to receive a burial casket of conventional size and construction.

Adjacent the crypt opening 18, each of the walls 16, 16' and top slabs 12, 14 are preferably provided with ledges 20 which extend about the entire perimeter of the opening 18. However, it is to be understood that the provision of such ledges 20 is not essential to the operation of the present invention as will be explained hereinafter.

A closure panel 22 according to the present invention has an outermost perimeter conforming substantially to the shape of the opening 18 and comprises a central section 24 of substantially planar form and a relatively resilient edge 26 bounding the entire perimeter of the central section 24. If desired, the central section 24 may be optionally provided with reinforcing ribs 28, as shown in phantom lines in FIG. 1, to impart additional strength. In a preferred construction, the closure panel 22 is formed in one piece of a plastic material of substantially uniform thickness, e.g., polycarbonate, polyvinyl chloride, polyamide, epoxy resins, etc. Glass fiber-reinforced epoxy is one material found to be very suitable for use as a closure panel made in accordance with this invention.

Figure 2:
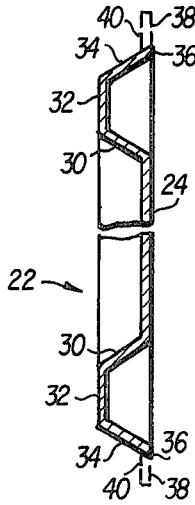
FIG. 2 is a cross-sectional side view of the closure panel of the invention.

As best seen in FIG. 2, the resilient edge 26 of closure panel 22 is configured generally as a U-shaped groove comprising a first perimetrical portion 30 corresponding to one leg of the "U" which extends outwardly from the central section 24 at an inclination thereto, a second perimetrical portion 32 corresponding to the base or bottom of the "U" and extending outwardly from the first portion 30 and generally parallel to the central section 24 and a third perimetrical portion 34 corresponding to the other leg of the "U" and extending outwardly at an inclination toward the plane of the central section 24. The outermost edge 36 of the closure panel 22 terminates, in one embodiment, at a point substantially coincident with the plane of central section 24. Alternatively, as shown in phantom lines in FIG. 2, a flange portion 38 extends outwardly from third portion 34 and substantially coplanar with the central section 24. This flange portion 38 advantageously provides a stop surface 40 which abuts the front wall surface of the crypt module adjacent the crypt opening and, thus, helps to limit the depth of insertion of the panel into the opening. This configuration is especially suited for crypt openings which are not provided with ledges.

The perimeter of the closure panel 22, as measured about the outermost edge 36, is at least equal to and, preferably, greater than the innermost perimeter of the crypt opening 18, as measured about the surfaces of ledges 20, so as to provide an interference fit between the closure panel 22 and the crypt opening 18. It will be appreciated by those skilled in the art that the particular form of the relatively resilient edge of the closure panel, as described above, provides sufficient flexibility to the third section 34 to permit engagement of the crypt surfaces about the opening thereof. Depending on the dimensional magnitude of the interference fit, additional flexibility is provided by the first section 30 which is capable of some inward flexure but to a lesser extent than section 34.

Figure 3:
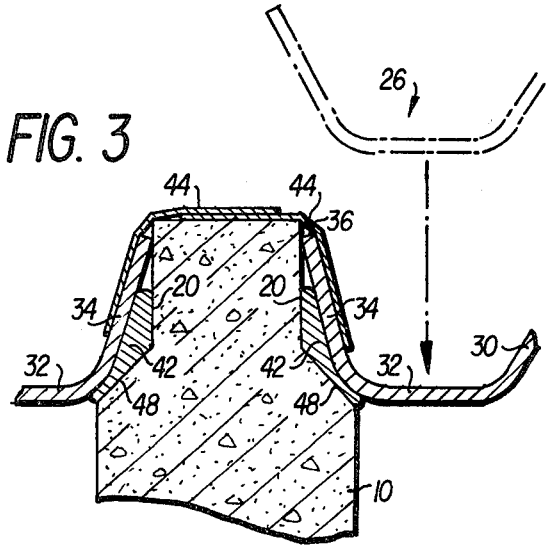
FIGS. 3 and 4 are broken cross-sectional views showing alternate embodiments of the closure panel resilient edge sealingly situated in the crypt module opening.
Figure 4:
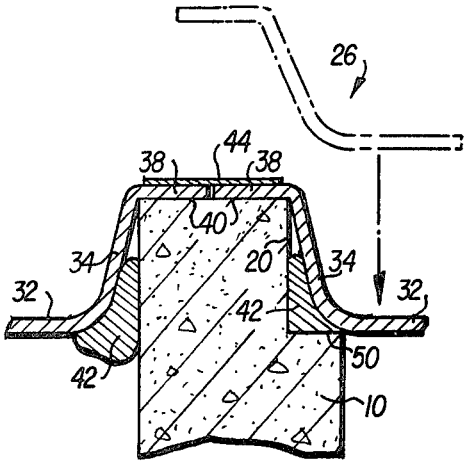

Referring now to FIGS. 3 and 4 which show enlarged views of the relationship between the resilient edges of installed closure panels 22 and the surfaces of the crypt openings, there is illustrated in phantom lines the relaxed condition of the relatively resilient edges 26 when the closure panels are aligned with a crypt opening. After applying a suitable sealant 42 to the ledges 20 and/or the side of the portion 34 of the closure panel which engages the surfaces of the crypt opening, the closure panel is aligned with the crypt opening and urged inwardly thereof until the outermost edge 36 (FIG. 3) is at least flush with the front wall of the crypt module 10, or, in the case of the embodiment shown in FIG. 4, until the stop surfaces 40 of the flange portion 38 abut the front wall of the module 10. As the closure panel is urged into the crypt opening, the edge portion 34 engages the ledge surfaces and yields inwardly substantially uniformly about the entire perimeter of the closure panel, thus maintaining the closure panel substantially centered and self-supporting in the crypt opening by the forces exerted between the resilient edge and the crypt opening.

As the ratio between the dimension of the closure panel and crypt opening perimeters is increased to magnitudes greater than 1:1, the first edge portion 30 provides additional flexibility and will also yield inwardly in response to the increased peripheral force exerted on the resilient edge of the closure panel. One important aspect of the above described construction of the closure panel of the invention is that the dimensional interference between the panel and crypt opening is taken up substantially entirely by the resilient edge 26 of the panel so that distortion, such as "oil canning" or similar distortion phenomena, of the central panel section 24 is greatly reduced without the need to increase the thickness of the central section.

After the closure panel has been installed in the crypt opening using the sealant 42, a strip of vinyl adhesive tape 44 is preferably applied about the panel edges, as shown in FIGS. 3 and 4. In addition, variations in the shape of the ledge 20 are possible and the ledges may include a portion 48 (FIG. 3) inclined with respect to the front wall of the crypt module 10 or a portion 50 (FIG. 4) substantially parallel to the front wall of the crypt module. In some cases, the ledges 20 may be entirely eliminated as shown in the left-hand portion of FIG. 4.

For the purpose of understanding and not limitation, it has been found that in the size range of crypt openings of the magnitude of 2–3 feet in height and breadth, a fiberglass laminate panel having a thickness of between about 3/32 and about 1/16 inch, a resilient edge groove depth of about 1 inch and a perimeter which overlaps the entire crypt opening perimeter by approximately $\frac{1}{8}$ inch, provides a crypt closure panel having a sufficiently flexible edge fo function satisfactorily in accordance with the present invention.

A further important feature of the present invention is that the closure panels described above are fabricated to "nest" with each other when stacked for shipment or storage. Owing to this nesting construction and the much lighter weight of the closure panel of this invention as compared with the prior art crypt closures, a large number of panels can be conveniently packaged in cardboard boxes for shipment and/or storage resulting in easier handling and lower shipping costs. In use, additional cost savings can be realized since one man can readily handle the crypt closure of the present invention without lifting equipment, in contrast to the two-man operation associated with conventional techniques.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. In combination with a crypt module having a polygonal opening therein for receiving a burial casket, a polygonal closure panel for fluid sealing said opening, said closure panel including relatively resilient edge means integrally formed with said closure panel and conformable substantially to the shape of the crypt module opening for sealing the opening, said edge means comprising a substantially U-shaped, inwardly yieldable groove extending about the perimeter of said closure panel and forming an interference fit between said opening and said closure panel when said closure panel is positioned in said crypt module opening.

2. The combination according to claim 1, including ledge means in said crypt module opening for receiving said closure panel.

3. The combination according to claim 1, including sealant means interposed between said crypt module opening and said edge means for forming a substantially fluid-tight seal therebetween.

4. The combination according to claim 1, wherein said closure panel is integrally formed of a plastic material having a substantially uniform thickness.

5. The combination according to claim 1, wherein the outermost perimeter of said closure panel, when in a relaxed condition, is greater than the perimeter of said crypt module opening such that said edge means is inwardly yieldable to form said intereference fit between said opening and said closure panel when said closure panel is inserted in said opening.

6. The combination according to claim 1, wherein said closure panel includes a central section having a substantially planar portion, said resilient edge means having a first portion extending outwardly from said central section at an inclination to the planar portion of said central section, a second portion extending from said first portion outwardly relative to said central section and substantially parallel with the planar portion thereof and a third portion extending from said second portion toward the plane of the planar portion of the central section and at an inclination thereto.

7. The combination according to claim 6, wherein said third portion terminates at an edge substantially coincident with the planar portion of the central section.

8. The combination according to claim 6, wherein said resilient edge means has a fourth flanged portion extending from said third portion outwardly relative to the central section and substantially coplanar with the planar portion thereof.

9. The combination according to claim 6, including means provided in said closure panel for reinforcing said central section.

* * * * *